US007407272B2

(12) United States Patent
Min et al.

(10) Patent No.: US 7,407,272 B2
(45) Date of Patent: Aug. 5, 2008

(54) INK JET HEAD SUBSTRATE AND INK JET HEAD HAVING METAL CARBON NITRIDE RESISTOR

(75) Inventors: Jae-Sik Min, Suwon-si (KR); Sung-Joon Park, Suwon-si (KR); Young-Ung Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 351 days.

(21) Appl. No.: 11/070,498

(22) Filed: Mar. 3, 2005

(65) Prior Publication Data

US 2005/0243140 A1 Nov. 3, 2005

(30) Foreign Application Priority Data

Mar. 11, 2004 (KR) ..... 10-2004-0016598

(51) Int. Cl.
*B41J 2/05* (2006.01)

(52) U.S. Cl. ..... 347/62; 347/63

(58) Field of Classification Search ..... 347/20, 347/56, 61–65, 67
See application file for complete search history.

(56) References Cited

U.S. PATENT DOCUMENTS

| | | | | |
|---|---|---|---|---|
| 4,500,895 | A | 2/1985 | Buck et al. | 347/63 |
| 5,122,812 | A | 6/1992 | Hess et al. | 347/59 |
| 6,336,713 | B1 | 1/2002 | Regan et al. | 347/62 |
| 6,375,312 | B1 | 4/2002 | Ikeda et al. | 347/62 |
| 6,527,813 | B1 | 3/2003 | Saito et al. | 347/62 |
| 7,198,358 | B2 * | 4/2007 | Sun et al. | 347/63 |

FOREIGN PATENT DOCUMENTS

| | | |
|---|---|---|
| CN | 1214991 | 4/1999 |
| CN | 1353451 | 6/2002 |
| CN | 1413835 | 1/2003 |
| JP | 59124869 | 7/1984 |
| JP | 10-114071 | 5/1998 |
| JP | 10-157121 | 6/1998 |
| KR | 010015482 A | 2/2001 |

OTHER PUBLICATIONS

Korean Office Action dated Oct. 28, 2005 issued in KR 2004-16598.
Chinese Office Action dated Dec. 29, 2006 issued in CN 2005100527928.
Japanese Office Action dated Jan. 8, 2008 issued in JP 2005-069925.

* cited by examiner

*Primary Examiner*—Juanita D Stephens
(74) *Attorney, Agent, or Firm*—Stanzione & Kim, LLP

(57) ABSTRACT

An ink jet head substrate, an ink jet head and method of manufacturing the ink jet head substrate. The ink jet head substrate includes a supporting structure and at least one heat-generating resistor disposed on the supporting structure to generate a thermal energy to eject ink and made of metal carbon nitride. The metal carbon nitride is represented as a chemical formula of $M_xC_yN_z$ where M is metal, X is within about 20 through 80, Y is within about 3 through 25, and Z is within about 10 through 60, when X+Y+Z=100. Further, the heat-generating resistor has a resistivity of 300~2000 μΩ·Cm.

12 Claims, 5 Drawing Sheets

INK JET HEAD SUBSTRATE AND INK JET HEAD HAVING METAL CARBON NITRIDE RESISTOR

CROSS-REFERENCE TO RELATED APPLICATIONS

This application claims the benefit of Korea Patent Application No. 2004-16598 filed on Mar. 11, 2004, the disclosure of which is hereby incorporated herein by reference in its entirety.

BACKGROUND OF THE INVENTION

1. Field of the Invention

The present general inventive concept relates to an ink jet head substrate, an ink jet head and method of manufacturing the ink jet head substrate and, more particularly, to an ink jet head substrate provided with a heat-generating resistor having an enhanced reliability and an expanded life span, an ink jet head having the ink jet head substrate, and method of manufacturing the ink jet head substrate.

2. Description of the Related Art

An ink jet recording device is a device for printing a picture by ejecting a minute droplet of printing ink to a desired position of a recording medium. Such an ink jet recording device is widely used because a price thereof is relatively low and various colors can be printed at a high resolution. Typically, the ink jet recording device comprises an ink jet head for ejecting the ink substantially and an ink storage unit for fluidly communicating with the ink jet head. Further, in the ink jet recording device, the ink jet head is divided into a thermal type using an electro-thermal transducer and a piezoelectric type using an electromechanical transducer according to a method of ejecting the ink. A thermal type ink jet recording device has been disclosed in U.S. Pat. Nos. 4,500,895 and 6,336,713.

Such an ink jet head (hereinafter referred to as a thermal ink jet head) used in the thermal type ink jet recording device (hereinafter referred to as a thermal ink jet recording device) generally comprises an ink jet head substrate and a nozzle plate provided with an aperture through which the ink is ejected. In the ink jet head substrate, there is provided an electro-thermal transducer for generating thermal energy to eject the ink. The electro-thermal transducer is generally made of an alloy containing a high melting point metal, such as tantalum (Ta), and will be hereinafter referred to as a heat-generating resistor. Preferably, the heat-generating resistor used in the thermal ink jet head of the thermal ink jet recording device has the following characteristics: (1) basically, it should have a high resistivity, (2) it should be able to reach a required temperature within an extremely short time so as to instantaneously eject the ink, (3) it should have a little variance in resistance so as to keep the droplet of the ejected ink uniform during a high speed operation and consecutive operations, and (4) it should have high endurance against thermal stress so as to expand a life span.

To satisfy the above-described characteristics, a conventional heat-generating resistor has been mostly made of TaAl. The thermal ink jet head employing the heat-generating resistor made of TaAl has been disclosed in U.S. Pat. No. 5,122,812. Meanwhile, the performance of the thermal ink jet recording device can be estimated on the basis of a printing resolution and a printing speed. To improve the printing resolution, there may be proposed a method of decreasing a size of the ejected ink droplet by reducing a size of the heat-generating resistor. In order to operate the thermal ink jet recording device under the same conditions as the conventional one even though the size of the heat generating resistor is reduced, a resistance of the heat-generating resistor should be increased. This can be seen in the following $$P/A = V \times I/A = I \times R^2/A = V^2/(R \times A) \quad \text{<Equation 1>}$$

where P/A is a power density, A is a area of a heat generating resistor, V is a driving voltage, I is a driving current, and R is a resistance of the heat generating resistor)

Generally, in the thermal ink jet recording device, in order to create a bubble required for ejecting the ink, the power density (P/A) should be over about 1~2 GW/cm$^2$. Therefore, in order to keep the power density (P/A) constant even though the area (A) of the heat-generating resistor is reduced, the resistance (R) of the heat-generating resistor should be increased. Further, according as the resistance (R) of the heat-generating resistor is increased, the driving current (I) of the thermal ink jet recording device can be decreased, which is advantageous in terms of energy requirement.

However, TaAl used as a material for the conventional heat-generating resistor has a resistivity of about 250~300 μΩ·cm and a sheet resistance of about 30 Ω/□ (or 30 Ω/square) at about 1000 Å thickness. Thus, there is a limitation in reducing the area of the heat-generating resistor. In order to increase the sheet resistance of the heat-generating resistor, there has been proposed a method of reducing a thickness of the heat-generating resistor, but this method causes the resistance to vary remarkably as the energy applied to the heat-generating resistor is increased, thereby causing the thermal ink jet recording device to be unstably operated.

Consequently, in the conventional thermal ink jet recording device, there is needed to develop the heat-generating resistor having a high resistivity and an enhanced thermal/mechanical endurance to achieve a high printing resolution and a stable high-speed operation. Thus, there have been disclosed a thermal ink jet head comprising a heat-generating resistor made of $Ta_xSi_yR_z$ in U.S. Pat. No. 6,527,813, and the ink jet head comprising the heat-generating resistor made of $TaN_{0.8hex}$ in U.S. Pat. No. 6,375,312.

SUMMARY OF THE INVENTION

In order to solve the foregoing and/or other problems, it is an aspect of the present general inventive concept to provide an ink jet head substrate with a heat-generating resistor having a high resistivity and an enhanced thermal/mechanical endurance.

Another aspect of the present general inventive concept is to provide an ink jet head with the ink jet head substrate.

Still another aspect of the present general inventive concept is to provide a method of manufacturing the ink jet head substrate.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing an ink jet head substrate provided with at least one heat-generating resistor made of metal carbon nitride. The ink jet head substrate comprises a supporting structure. The at least one heat-generating resistor is disposed on the supporting structure to generate thermal energy to eject ink and is made of metal carbon nitride.

In an aspect of the present general inventive concept, the metal carbon nitride is represented as a chemical formula of $M_xC_yN_z$ where M is metal, X is within about 20 through 80, Y is within about 3 through 25, Z is within about 10 through 60, when X+Y+Z=100. In another aspect of the present general inventive concept, the metal is one selected from a group consisting of tantalum (Ta), tungsten (W), chrome (Cr), molybdenum (Mo), titanium (Ti), zirconium (Zr), hafnium (Hf), and a combination thereof. Also, the heat-generating resistor has a resistivity of about 300~2000 μΩ·Cm and has a thickness of about 100~2000 Å.

In yet another aspect of the present general inventive concept, the ink jet head substrate further comprises a thermal barrier layer interposed at least between the supporting structure and the heat-generating resistor. Wiring lines are electrically connected to the heat-generating resistor and supply an electric signal to the heat-generating resistor to generate a thermal energy. A passivation layer is disposed to cover the heat-generating resistor and the wiring liens. An anti-cavitation layer is disposed on the passivation layer to overlap at least with the heat-generating resistor.

The foregoing and/or other aspects of the present general inventive concept may also be achieved by providing an ink jet head having an ink jet head substrate. The ink jet head comprises a supporting structure. At least one heat-generating resistor is disposed on the supporting structure to generate a thermal energy to eject ink, and is made of metal carbon nitride. A chamber structure having at least one aperture to eject ink is disposed on the supporting structure to define at least one ink chamber having the heat-generating resistor therein.

In an aspect of the present general inventive concept, the metal carbon nitride is represented as a chemical formula of $M_xC_yN_z$ where M is metal, X is within about 20 through 80, Y is within about 3 through 25, and Z is within about 10 through 60, when X+Y+Z=100. It is possible that the heat-generating resistor has a resistivity of 300~2000μΩ·Cm.

The foregoing and/or other aspects of the preset general inventive concept may also be achieved by providing a method of manufacturing an ink jet head substrate. The method comprises preparing a supporting structure and forming a heat-generating resistive layer made of metal carbon nitride on the supporting structure.

In an aspect of the present general inventive concept, the metal carbon nitride is represented as a chemical formula of $M_xC_yN_z$ where M is metal, X is within about 20 through 80, Y is within about 3 through 25, and Z is within about 10 through 60, when X+Y+Z=100.

In another aspect of the present general inventive concept, the method further comprises forming a thermal barrier layer on the supporting structure before forming the heat-generating resistive layer, and forming a wiring conductive layer on the heat-generating resistive layer after forming the heat-generating resistive layer. The wiring conductive layer and the heat-generating resistive layer are patterned to form a wiring conductive layer pattern and a heat-generating resistive layer pattern. The wiring conductive layer pattern is selectively removed to form a wiring line exposing a predetermined area of the heat-generating resistive layer pattern, and at the same time, to define a heat-generating resistor at a portion of the heat-generating resistive layer pattern exposed by the wiring line. A passivation layer is formed to cover the wiring line and the heat-generating resistor. An anti-cavitation layer is formed to overlap at least with the heat-generating resistor on the passivation layer.

In yet another aspect of the present general inventive concept, the heat-generating resistive layer is formed using one of an atomic layer deposition (ALD) method, a reactive sputtering method, and a chemical vapor deposition (CVD) method.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
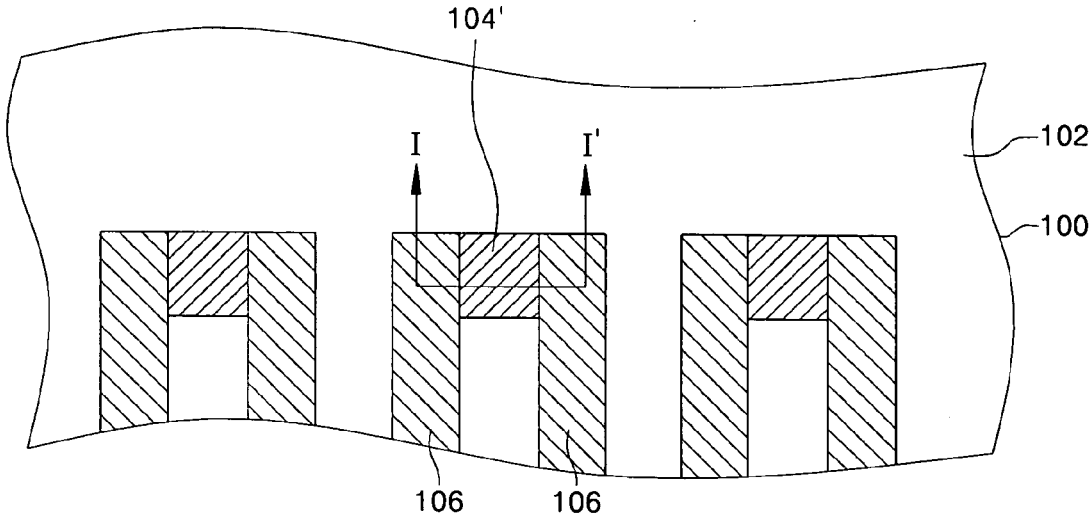
FIG. 1 is a partial plan view illustrating an ink jet head substrate used with ink jet head and a thermal ink jet recording device according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. In the drawings, the thickness of layers and regions are exaggerated for clarity. Like numbers refer to like elements throughout the specification.

Figure 2:
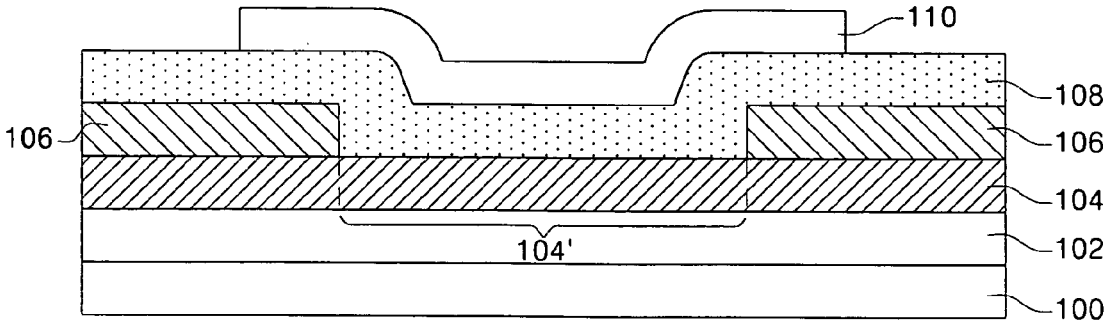
FIG. 2 is a cross-sectional view taken along a line I-I' of FIG. 1.

FIG. 1 is a partial plan view illustrating an ink jet head substrate used with an ink jet head and a thermal ink jet recording device according to an embodiment of the present general inventive concept, and FIG. 2 is a cross-sectional view taken along a line I-I' of FIG. 1.

Referring to FIGS. 1 and 2, a heat-generating resistive layer pattern 104 can be disposed on a supporting structure 100. A heat-generating resistor 104' can occupy a predetermined area of the heat-generating resistive layer pattern 104. That is, the heat-generating resistor 104' can be a portion of the heat-generating resistive layer pattern 104, which is exposed by wiring lines 106 disposed on the heat-generating resistive layer pattern 104. Hereinafter, descriptions about a material of the heat-generating resistor 104' will also be applied to the heat-generating resistive layer pattern 104. The heat-generating resistive layer pattern 104 and the wiring lines 106 may be stacked, and the heat-generating resistor 104' can be defined by the portion exposed by the wiring lines 106. The wiring lines 106 can be employed to apply an electrical signal to the heat-generating resistor 104'. Here, the wiring lines 106 (to be described later) can be made of a material having a resistance lower than that of the heat-generating resistor 104'. Therefore, in an area on which the wiring lines 106 are disposed, the wiring lines 106 having the low resistance are employed as a channel of an electric current. Therefore, the area on which the wiring lines 106 are not disposed, that is, the heat-generating resistor 104', can be employed as a heating element to generate a thermal energy to eject ink.

The supporting structure 100 can be used as a base layer to support elements constituting the ink jet head substrate and may be a single crystal silicon substrate. The wiring lines 106 can be made of conductive materials, such as aluminum (Al), aurum (Au), copper (Cu), tungsten (W), platinum (P), and preferably made of the aluminum (Al).

Figure 3:
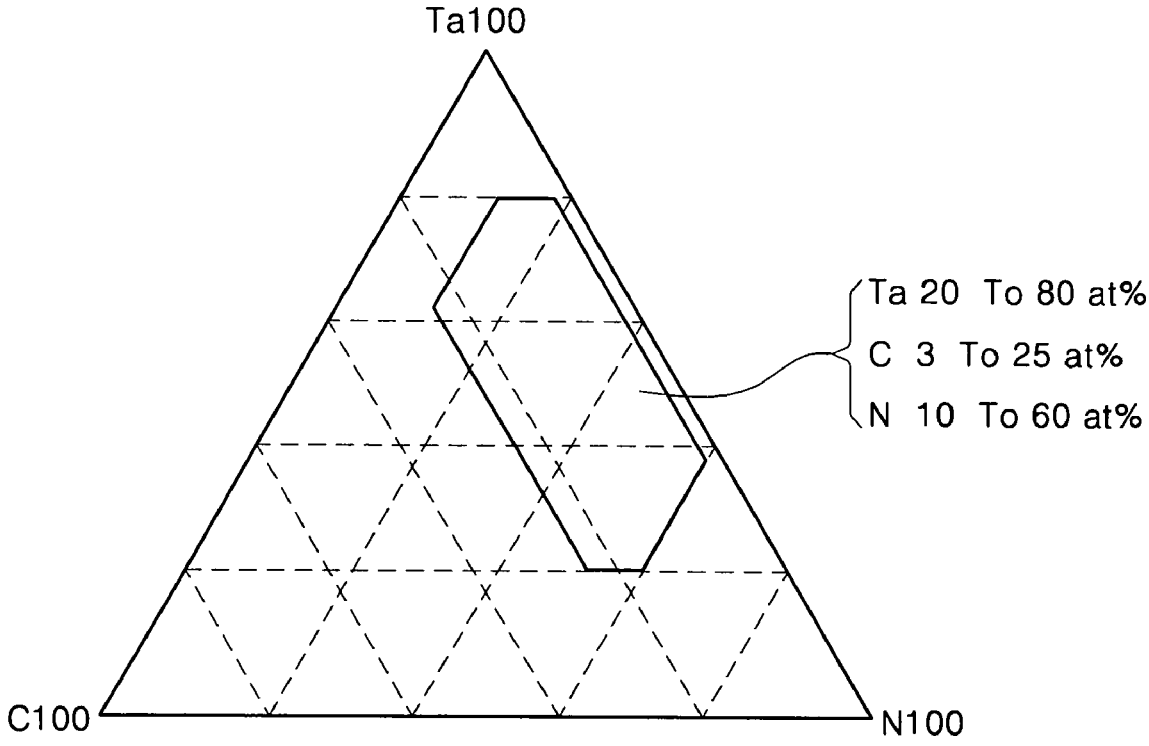
FIG. 3 is a view illustrating a composition range of a heat-generating resistor according to another embodiment of the present general inventive concept.

The heat-generating resistor 104' can be made of metal carbon nitride. The metal carbon nitride can be a compound of metal, carbon and nitrogen. Also, the metal carbon nitride is represented as a chemical formula of $M_xC_yN_z$ wherein "M" indicates the metal and "X", "Y" and "Z" indicate atomic percentages of the respective components, that is, X+Y+Z=100. According to an aspect of the present general inventive concept, in the chemical formula of $M_xC_yN_z$, X is within about 20 through 80, Y is within about 3 through 25, and Z is within about 10 through 60. Further, various metals may be used without a limitation in realizing an effect of the present general inventive concept. To obtain an optimal effect of the present invention, a high melting point metal or transition metal can be used, and such a metal is one selected from a group consisting of tantalum (Ta), tungsten (W), chrome (Cr), molybdenum (Mo), titanium (Ti), zirconium (Zr), hafnium (Hf), and a combination thereof. FIG. 3 is a view illustrating a composition range of $Ta_xC_yN_z$ used for the heat-generating resistor 104' of FIG. 2. 1 and 2. In another aspect of the present general inventive concept, the heat-generating resistor 104' of the chemical formula and the composition can have a resistivity of 300-2000 μΩ·Cm. Within the resistivity range, the heat-generating resistor 104' may have a thickness in a relatively broad range, for example, a thickness of about 100-2000 Å.

As described above, the heat-generating resistor 104' can be made of the metal carbon nitride. The metal carbon nitride has a resistivity higher than TaAl used as a thermal heat-generating resistor in a conventional thermal ink jet head. Thus, the resistance of the heat-generating resistor 104' can be increased, so that a size of the heat-generating resistor 104' may be reduced, thereby achieving a high printing resolution. Further, according as a driving current (I) of the thermal ink jet recording device may be decreased, it is advantageous in terms of the energy requirement. Furthermore, according as a high melting point metal, carbon and nitrogen are alloyed, it is expected that the heat-generating resistor 104' can be strengthened in thermal/mechanical characteristics. Such strengthening mechanism may be understood by a solid solution strengthening or dispersion strengthening theory. Consequently, the heat-generating resistor 104' according to another aspect of the present general inventive concept can improve an enhanced reliability and an expanded life span.

Referring back to FIGS. 1 and 2, the ink jet head substrate may further comprise components other than the above-described supporting structure 100 including the heat-generating resistive layer pattern 104, the heat-generating resistor 104', and the wiring lines 106. Between the supporting structure 100 and the heat-generating resistive layer pattern 104 can be interposed a thermal barrier layer 102. The thermal barrier layer 102 may cover a whole surface of the supporting structure 100. The thermal barrier layer 102 may be made of a silicon oxide layer and can be employed to prevent the energy generated in the heat-generating resistor 104' from being lost through the supporting structure 100. Additionally, a passivation layer 108 can be disposed to cover the heat-generating resistor 104' and the wiring lines 106. The passivation layer 108 can be employed to protect the heat-generating resistor 104' and the wiring lines 106 from corrosion due to the ink and from other physical damage. Here, the passivation layer 108 may be made of a silicon oxide (SiO) layer, a silicon nitride (SiN) layer or a silicon carbide (SiC) layer. On the passivation layer 108 can be provided an anti-cavitation layer 110. The anti-cavitation layer 110 can be employed to protect the heat-generating resistor 104 from physical damage by a pressure change caused by the ejection of the ink. To achieve this aspect, the anti-cavitation layer 110 can be disposed to overlap at least with the heat-generating resistor 104'. The anti-cavitation layer 110 can be made of Ta, W, Mo or alloy thereof, and is preferably made of Ta.

The ink jet head substrate according to an aspect of the present general inventive concept may comprise the heat-generating resistor 104' made of metal carbon nitride. Therefore, the heat-generating resistor 104' and the wiring lines 106 are illustrated in FIG. 1 by way of an example, but not limited thereto.

Figure 4:
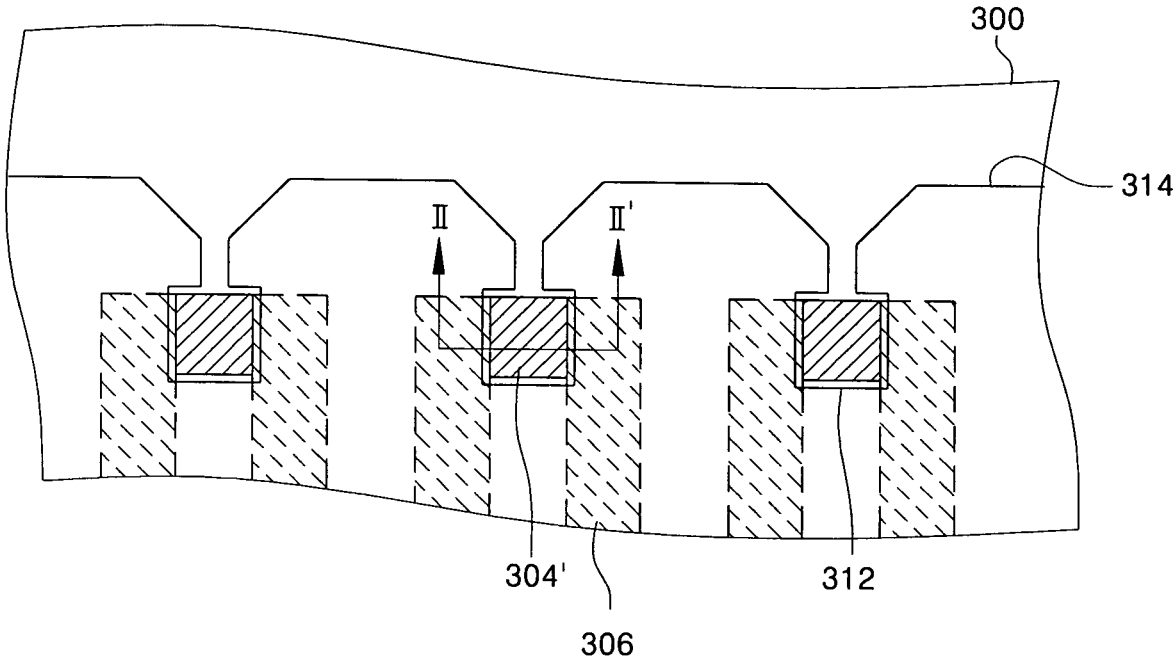
FIG. 4 is a partial plan view illustrating an ink jet head according to another embodiment of the present general inventive concept.
Figure 5:
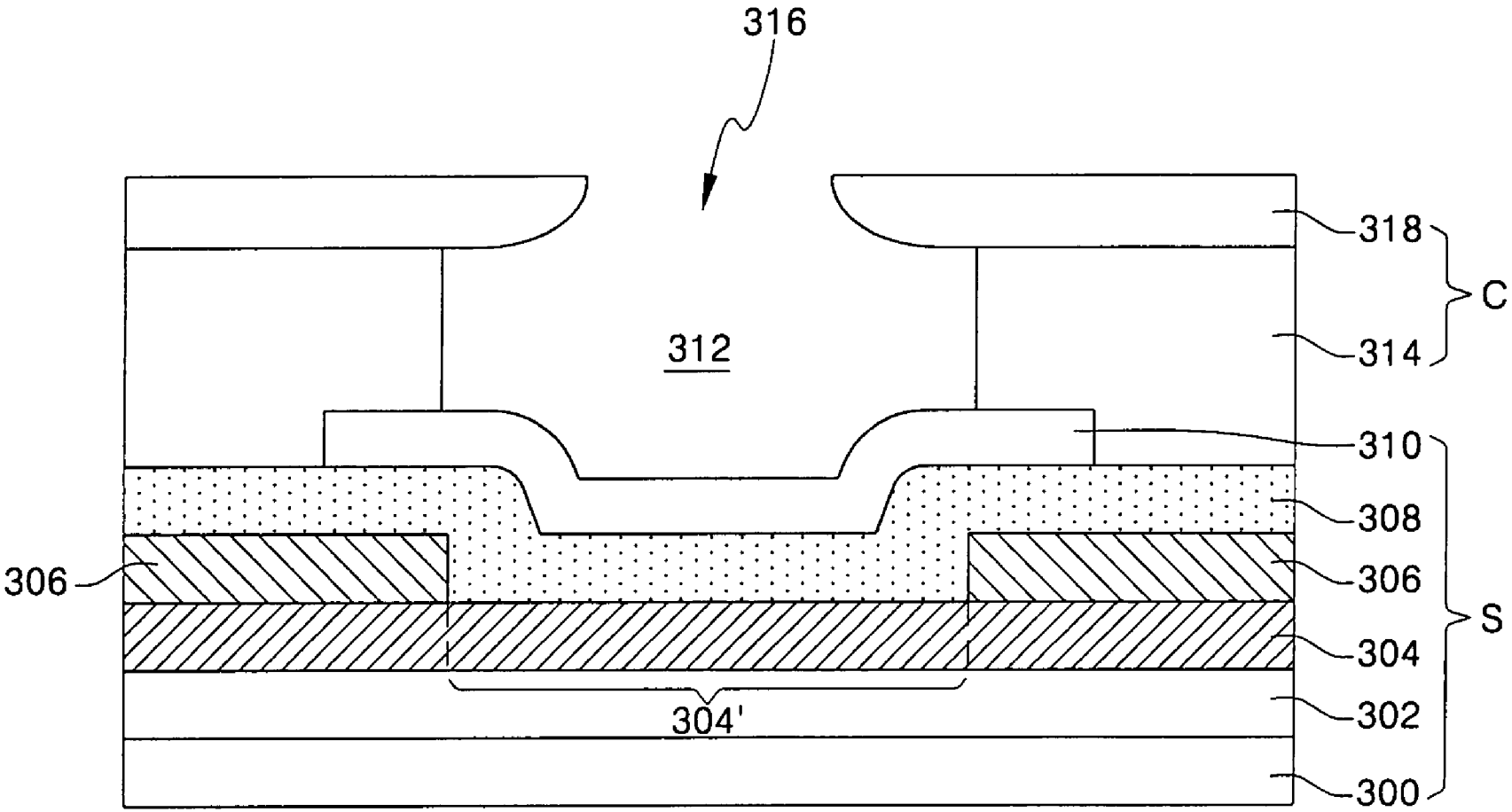
FIG. 5 is a cross-sectional view taken along a line II-II' of FIG. 4.

FIG. 4 is a partial plan view illustrating an ink jet head according to another embodiment of the present general inventive concept, and FIG. 5 is a cross-sectional view taken along a line II-II' of FIG. 4.

Referring to FIGS. 4 and 5, the ink jet head may comprise an ink jet head substrate S, and a chamber structure C. The ink jet head substrate S may comprise the same elements as described in FIGS. 1 and 2. That is, the ink jet head substrate S may comprise a supporting structure 300, a thermal barrier layer 302, a heat-generating resistive layer pattern 304, a heat-generating resistor 304', wiring lines 306, a passivation layer 308, and an anti-cavitation layer 310. The heat-generating resistor pattern 304 having the heat-generating resistor 304' may be made of metal carbon nitride. Also, the metal carbon nitride may be represented as a chemical formula of $M_xC_yN_z$, wherein "M" indicates the metal and "X", "Y" and "Z" indicate atomic percentages of the respective components, that is, X+Y+Z=100. In this embodiment, in the chemical formula of $M_xC_yN_z$, is within about 20 through 80, Y is within about 3 through 25, and Z is within about 10 through 60. Further, various metals may be used without a limitation in realizing the effect of the present general inventive concept. To obtain an optimal effect of the present general inventive concept, a high melting point metal or transition metal is preferable and such metal is one selected from a group consisting of tantalum (Ta), tungsten (W), chrome (Cr), molybdenum (Mo), titanium (Ti), zirconium (Zr), hafnium (Hf), and a combination thereof. In this embodiment, the heat-generating resistor 304' of the chemical formula and the composition has a resistivity of 300~2000μΩ·Cm. Within the resistivity range, the heat-generating resistor 304' may have a thickness in a relatively broad range, particularly, a thickness of 100~2000 Å.

The chamber structure C can be disposed on the ink jet head substrate S. The chamber structure C may comprise a side wall structure 314 and a material layer 318. The side wall structure 314 can define an ink chamber 312 having the heat-generating resistor 304' therein. The material layer 318 can be disposed on the side wall structure 314 and have at least one aperture 316 through which the ink is ejected. Here, the aperture 316 may be called a nozzle or an orifice and may be disposed over the heat-generating resistor 304'. The side wall structure 314 or the material layer 318 provided with the aperture 316 may be made of various materials. For example, the side wall structure 314 may be made of an organic compound monomer or polymer having a high dielectric constant. Further, the material layer 318 may be made of a metal plate containing nickel (Ni) as main composition. Further, the side wall structure 314 and the material layer 318 may be integrally formed of the same material.

Figure 6:
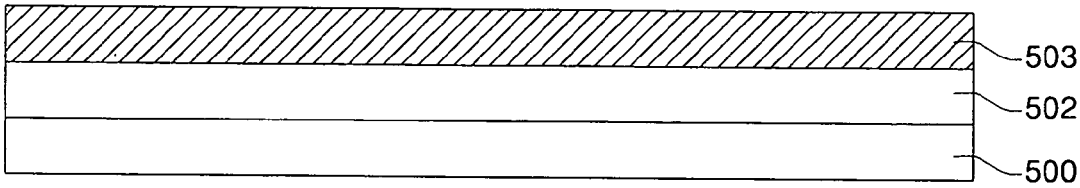
FIGS. 6 and 7 are cross-sectional views taken along the line I-I' of FIG. 1 to illustrate a method of manufacturing an ink jet head substrate according to another embodiment of the present general inventive concept.
Figure 7:
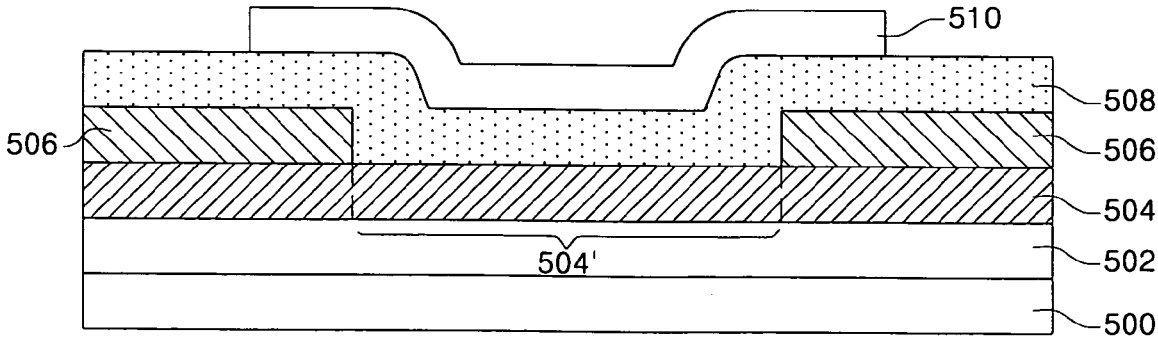

FIGS. 6 and 7 are cross-sectional views taken along a line I-I' of FIG. 1 to illustrate a method of manufacturing an ink jet head substrate according to another embodiment of the present general inventive concept.

Referring to FIGS. 1 and 6, there is prepared a supporting structure 500. The supporting structure 500 may be a single crystal silicon substrate. A thermal barrier layer 502 can be formed on the supporting structure 500. The thermal barrier layer 502 may be formed of a silicon oxide layer. Further, the thermal barrier layer 502 may be formed by a well-known thermal oxidation method or a well-known chemical vapor deposition (CVD) method. A heat-generating resistive layer 503 can be formed on the thermal barrier layer 102. The heat-generating register layer 503 can be made of metal carbon nitride. The metal carbon nitride can be represented as a chemical formula of $M_xC_yN_z$, wherein "M" indicates the metal and "X", "Y" and "Z" indicate atomic percentages of the respective components, that is, X+Y+Z=100. In this embodiment, in the chemical formula of $M_xC_yN_z$, X is within about 20 through 80, Y is within about 3 through 25, and Z is within about 10 through 60. Further, various metals may be used without a limitation in realizing the effect of the present general inventive concept. To obtain an optimal effect of the present general inventive concept, a high melting point metal or transition metal is preferable and such metal is one selected from a group consisting of tantalum (Ta), tungsten (W), chrome (Cr), molybdenum (Mo), titanium (Ti), zirconium (Zr), hafnium (Hf, and a combination thereof. In this embodiment, the heat-generating resistive layer 503 of the chemical formula and the composition has a resistivity of 300~2000 μΩ·Cm. Within the resistivity range, the heat-generating resistive layer 503 may have a thickness in a relatively broad range, particularly, a thickness of 100~2000 Å.

The heat-generating resistive layer 503 may be preferably formed using an atomic layer deposition (ALD) method. The atomic layer deposition (ALD) method is a method of forming an atomic layer thin film on the basis of alternating chemisorption, surface reaction, and byproduct desorption. As the heat-generating resistive layer 503 is formed by the ALD method, the composition of the atomic layer thin film can be precisely controlled and therefore the resistivity of the heat-generating resistive layer 503 can be easily controlled. In this embodiment, the heat-generating resistive layer 503 may be formed using a plasma enhanced atomic layer deposition (PEALD) method in which reaction between reactants is more actively performed.

A process of forming the heat-generating resistive layer 503 made of $Ta_xC_yN_z$ using the ALD will be explained hereinafter. First, temperature and pressure of a reactor can be kept at about 300~400° C. and about $10^{-1}$~10 Torr, respectively. Then, tantalum, carbon and nitrogen sources can be injected into the reactor by time-sharing. At this time, an organic metal containing TaCl5 may be used as the tantalum source, and methane gas ($CH_4$) and ammonia gas ($NH_3$) may be used as the carbon and nitrogen sources, respectively. Further, after each source is injected into the reactor, a purge process can be performed before the next source is injected. The purge process may be performed by injecting an inert gas, such as argon gas (Ar), into the reactor. Thus, the heat-generating resistive layer 503 may have a desired thickness by repeating the foregoing processes.

Besides, the heat-generating resistive layer 503 may be formed by a reactive sputtering method, a CVD method, or a metallorganic chemical vapor deposition (MOCVD) method. In a case of the reactive sputtering method, the heat-generating resistive layer 503 may be formed by using a metal powder as a target material under a mixture atmosphere of the $N_2$ and $CH_4$ gases or by using metal-carbon powder as the target material under an atmosphere of the $N_2$ gas. The metal contained in the target material can be one selected from a group consisting of tantalum (Ta), tungsten (W), chrome (Cr), molybdenum (Mo), titanium (Ti), zirconium (Zr), hafnium (Hf), and a combination thereof.

Referring to FIGS. 1 and 7, after the heat-generating resistive layer 503 is formed, a wiring conductive layer can be formed on the heat-generating resistive layer 503. The wiring conductive layer may be formed of a conductive material such as aluminum (Al), aurum (Au), copper (Cu), tungsten (W), platinum (Pt), etc. The wiring conductive layer may be formed using the sputtering or CVD method. Then, the wiring conductive layer and the heat-generating resistive layer 503 can be patterned to form a wiring conductive layer pattern and a heat-generating resistive layer pattern 504, which are sequentially stacked on a thermal barrier layer 502. The process of patterning the wiring conductive layer and the heat-generating resistive layer 503 may be performed using a photolithography process or a dry etching process. Then, the wiring conductive layer pattern can be selectively removed to form wiring lines 506 exposing a predetermined area of the heat-generating resistive layer pattern 504. Thus, a heat-generating resistor 504' can be defined at the portion of the heat-generating resistive layer pattern 504 exposed by the wiring lines 506. The process of selectively removing the wiring conductive layer pattern may be performed using the photolithography process and the dry etching process.

Then, a passivation layer 508 can be formed on the wiring lines 506 and the heat-generating resistor 504'. The passivation layer 508 may be formed of a silicon oxide layer, a silicon nitride layer or a silicon carbide layer. For example, in a case that the passivation layer 508 is formed of the silicon nitride layer, the silicon nitride layer may be formed using the plasma enhanced chemical vapor deposition (PECVD) method. Further, on the passivation layer 508 can be formed an anti-cavitation layer 510. The anti-cavitation layer 510 may be formed of Ta, W, Mo or alloy thereof, and may be formed of the Ta. For example, a process of forming the anti-cavitation layer 510 of the Ta is as follows. A Ta layer can be formed on the passivation layer 508 by a sputtering method. Then, the Ta layer can be patterned to form the anti-cavitation layer 510 overlapping at least with the heat-generating resistor 504 as shown in FIG. 7. The Ta layer may be patterned by a photolithography process and a dry etching process.

As described above, in the ink jet head substrate and the ink jet head according to the embodiment of the present general inventive concept, the heat-generating resistor generating the thermal energy to eject ink is made of metal carbon nitride.

In the embodiments of the present general inventive concept, the heat-generating resistor has a high resistivity so that an area thereof may be decreased, thereby achieving a high printing resolution.

Further, a driving current for the ink jet recording device may be decreased, so that it is advantageous in terms of energy requirement.

Additionally, the heat-generating resistor has an enhanced thermal/mechanical endurance, thereby enhancing a reliability and a life span.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink jet head substrate used with an ink jet head, comprising:

a supporting structure; and at least one heat-generating resistor disposed on the supporting structure to generate thermal energy to eject ink, wherein the heat-generating resistor is made of metal carbon nitride represented as a chemical formula of $M_xC_yN_z$, where M is X is within about 20 through 80, Y is within about 3 through 25, and Z is within about 10 through 60, when X+Y+Z=100.

2. The ink jet head substrate as claimed in claim 1, wherein the metal is one selected from a group consisting of Ta, W, Cr, Mo, Ti, Zr, Hf, and a combination thereof.

3. The ink jet head substrate as claimed in claim 1, wherein the heat-generating resistor has a resistivity of about 300~2000 μΩ·Cm.

4. The ink jet head substrate as claimed in claim 1, wherein the heat-generating resistor has a thickness of about 100~2000 Å.

5. The ink jet head substrate as claimed in claim 1, further comprising:

a thermal barrier layer interposed at least between the supporting structure and the heat-generating resistor;

wiring lines electrically connected to the heat-generating resistor to supply an electric signal to the heat-generating resistor to generate the thermal energy;

a passivation layer covering the heat-generating resistor and the wiring lines; and an anti-cavitation layer disposed on the passivation layer to overlap at least with the heat-generating resistor.

6. An ink jet head comprising:

an ink jet head substrate having a supporting structure and at least one heat-generating resistor disposed on the supporting structure to generate a thermal energy to eject ink, wherein the heat-generating resistor is made of metal carbon nitride represented as a chemical formula of $M_xC_yN_z$, where M is metal, X is within about 20 through 80, Y is within about 3 through 25, and Z is within about 10 through 60, when X+Y+Z=100; and a chamber structure disposed on the inkjet head substrate to define at least one ink chamber having the heat-generating resistor therein, and having at least one aperture through which the ink is ejected.

7. The ink jet head as claimed in claim 6, wherein the metal is one selected from a group consisting of Ta, W, Cr, Mo, Ti, Zr, Hf, and a combination thereof.

8. The ink jet head as claimed in claim 6, wherein the heat-generating resistor has a resistivity of 300~2000 μΩ·Cm.

9. The ink jet head as claimed in claim 6, wherein the heat-generating resistor has a thickness of about 100~2000 Å.

10. The ink jet head as claimed in claim 6, further comprising:

a thermal barrier layer interposed at least between the supporting structure and the heat-generating resistor;

wiring lines electrically connected to the heat-generating resistor to supply an electrical signal to the heat-generating resistor to generate the thermal energy;

a passivation layer covering the heat-generating resistor and the wiring lines; and an anti-cavitation layer disposed on the passivation layer to overlap at least with the heat-generating resistor.

11. The ink jet head as claimed in claim 6, wherein the chamber structure comprising:

a side wall structure defining a side wall of the ink chamber; and a material layer disposed on the side wall structure to form one surface of the ink chamber and provided with at least one aperture through which the ink is ejected.

12. An ink jet head comprising:

an ink jet head substrate having a supporting structure, a heat-generating resistive layer pattern formed on the supporting structure and made of a tertiary compound including a metal component, carbon, and nitrogen in accordance with a chemical formula $M_xC_yN_z$, where M is the metal component, X is within about 20 through 80, Y is within about 3 through 25, and Z is within about 10 through 60, when X+Y+Z=100, a conductive layer formed on a first and a second portions of the heat-generating resistive layer pattern to form wiring lines, a passivation layer formed on the wiring lines of the conductive layer and a third portion of the heat-generating resistive layer pattern disposed between the first and second portions, and an anti-cavitation layer formed on the passivation layer; and a chamber structure formed on the ink jet heat substrate to define an ink chamber and a nozzle to correspond to the third portion of the heat-generating resistive layer pattern.

* * * * *